United States Patent [19]

Dillon et al.

[11] Patent Number: 4,891,049

[45] Date of Patent: Jan. 2, 1990

[54] HYDROCARBON FUEL COMPOSITION CONTAINING CARBONATE ADDITIVE

[75] Inventors: Diane M. Dillon, Fullerton; Ross Y. Iwamoto, Huntington Beach, both of Calif.

[73] Assignee: Union Oil Company of California, Brea, Calif.

[21] Appl. No.: 811,953

[22] Filed: Dec. 20, 1985

[51] Int. Cl.[4] ..... C10L 1/18
[52] U.S. Cl. ..... 44/53; 44/70
[58] Field of Search ..... 44/70, 53

[56] References Cited

U.S. PATENT DOCUMENTS

| | | | |
|---|---|---|---|
| 2,331,386 | 10/1943 | Gaylor | 44/70 |
| 2,844,450 | 7/1958 | Heisler et al. | 44/70 |
| 4,207,078 | 6/1980 | Sweeney et al. | 44/56 |
| 4,378,973 | 4/1983 | Sweeney | 44/56 |
| 4,380,455 | 4/1983 | Smith | 44/70 |

*Primary Examiner*—William R. Dixon, Jr.
*Assistant Examiner*—Ellen M. McAvoy
*Attorney, Agent, or Firm*—Gregory F. Wirzbicki; Arthur E. Oaks

[57] ABSTRACT

Hydrocarbon fuels heavier than gasoline, especially diesel fuel compositions, contain carbonate additives, preferably non-aromatic, metals-free carbonates, to reduce particulate emissions therefrom when combusted in an internal combustion engine.

34 Claims, No Drawings

HYDROCARBON FUEL COMPOSITION CONTAINING CARBONATE ADDITIVE

BACKGROUND OF THE INVENTION

This invention relates to organic additives for suppressing particulate emissions and hydrocarbon fuels containing the additives. These additives are useful for reducing soot, smoke and particulate emissions from hydrocarbon fuels.

The petroleum industry has encountered numerous problems in supplying hydrocarbon fuels, especially middle distillate fuels suitable for use in compression ignition and jet engines. One problem associated with combustion of hydrocarbon fuels in these engines is that they contribute materially to pollution of the atmosphere through soot, smoke and particulate emissions in engine exhaust gases.

The particulate matter formed in combustion of hydrocarbon fuels, especially middle distillate fuels, such as diesel fuels, and residual fuels, such as non-distillate fuel oils, is commonly referred to as soot. When present in sufficient particle size and quantity, soot in engine, boiler or burner exhaust gases appears as a black smoke. Soot formation in exhaust gases is highly undesirable since it causes environmental pollution, engine design limitations, and possible health problems.

Diesel-type engines are well known for being highly durable and fuel efficient. Because of this durability and fuel efficiency, diesel-type engines have long been used in heavy-duty motor vehicles, such as trucks, buses and locomotives. Recently, however, the automotive industry is using diesel-type engines in passenger automobiles and light-duty trucks to achieve greater fuel economy and conserve gasoline. This increased use of diesel-type engines materially adds to pollution of the atmosphere through increased soot, smoke and particulate emissions from engine exhaust gases.

Several attempts have been made to reduce emissions from diesel-type engines through the use of additives to middle distillate fuels. For example, U.S. Pat. No. 3,817,720 relates to organic smoke suppressant additives and distillate hydrocarbon fuels containing the same. The preferred organic additives are ethers of hydroquinone. These compounds are ethers of phenolic-type compounds which contain two oxygen atoms attached to each phenyl moiety.

The suppression of particulate emissions from diesel engines is described in U.S. Pat. No. 4,240,802, which discloses the addition of a minor amount of a cyclopentadienyl manganese tricarbonyl and a lower alkyl or cycloalkyl nitrate to a hydrocarbon fuel. These compounds are described as useful in reducing particulate emissions of fuel oil.

It is an object of the present invention to provide liquid hydrocarbon fuel compositions heavier than gasoline having enhanced properties for suppressing particulate emissions.

Another object of the present invention is to provide a middle distillate fuel composition having properties for reducing soot and smoke emissions.

Other objects and advantages of the invention will be apparent from the following description.

SUMMARY OF THE INVENTION

The present invention resides in a hydrocarbon fuel composition having properties for suppressing emissions of particulates which comprises a liquid hydrocarbon fuel heavier than gasoline and a sufficient amount of at least one carbonate so as to reduce the amount of particulate emissions from the combustion of the fuel.

DETAILED DESCRIPTION OF THE INVENTION

The present invention resides in a hydrocarbon fuel having properties for suppression of particulate emissions during combustion. In particular, the present invention relates to hydrocarbon fuel compositions comprising a hydrocarbon fuel heavier than gasoline and at least one carbonate additive, preferably a carbonate compound containing at least 3 carbon atoms and being free of metals and aromatics, so as to reduce the particulate emissions resulting from the combustion of the hydrocarbon fuel. It should be noted that reference to carbonate additives is inclusive of both a single species of carbonate and a mixture of species of carbonates.

Generally the carbonate additive is of the formula:

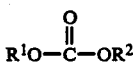

where $R_1$ and $R_2$ are the same or different monovalent organic radicals with between 1 and 10 carbon atoms. As used herein an organic radical is one containing at least one carbon atom. Usually $R^1$ and $R^2$ are the same or different monovalent aliphatic or alicyclic radicals with between 1 and 10 carbon atoms. More preferably $R^1$ and $R^2$ are the same or different substituted or unsubstituted (but preferably unsubstituted) alkyl, cycloalkyl, alkenyl, alkynyl, hydroxyalkyl, alkoxyalkyl, nitroalkyl, acyloxyalkyl, carbalkoxyalkyl, carbalkoxy or 1,3-dioxolane-1-one-4-ylalkyl radicals having between 1 and 10 carbon atoms. Yet more preferably $R^1$ and $R^2$ are the same or different alkyl, alkoxyalkyl, carbalkoxyalkyl, or carbalkoxy radicals having between 1 and 7 carbon atoms. And most preferably $R^1$ and $R^2$ are alkyl and carbalkoxy radicals having between 1 and 7 carbon atoms.

Examples of carbonate compounds suitable for use as additives in this invention are: dimethyl carbonate, diethyl carbonate, di-n-propyl carbonate, di-iso-propyl carbonate, sec-butyl propyl carbonate, ethyl methyl carbonate, hexyl methyl carbonate, ethyl vinyl carbonate, methyl propynyl carbonate, cyclohexyl methyl carbonate, bis(2-methoxyethyl) carbonate, ethyl 2-nitrobutyl carbonate, 1-carbethoxyethyl methyl carbonate, dimethyl dicarbonate, diethyl dicarbonate, methyl 2-tetrahydrofuranyl carbonate, acetyloxyethyl methyl carbonate, 3-hydroxybutyl methyl carbonate, 1,3-dioxolane-2-one-4-ylmethyl methyl carbonate and ethylene carbonate.

The preferred method by which carbonates may be prepared is by the reaction of phosgene with alcohols. For example, low molecular weight carbonates are normally prepared by passing one equivalent of phosgene (carbonyl chloride) into a solution of greater than two equivalents of the appropriate alcohol in a non-reactive solvent, such as benzene, at low temperatures (0° to 65° C.). The reaction can be catalyzed by addition of a tertiary organic base or pyridine, both of which act as acid acceptors.

An alternative procedure for low molecular weight carbonates and for higher molecular weight carbonates is to react under reflux two equivalents of the appropriate alcohol with two equivalents of metallic sodium to form the sodium alkoxide. The alkoxide is diluted with a suitable solvent, such as benzene, and one equivalent of phosgene is slowly added at 0° C. to yield the carbonate.

Mixed carbonates are normally prepared by passing one equivalent of phosgene into a solution of one equivalent of the appropriate alcohol in benzene, or in another suitable solvent, and pyridine at low temperatures (0° to 10° C.). The chloroformic ester formed in this reaction is isolated and reacted with one equivalent of a second alcohol in the presence of a tertiary organic base or pyridine to form the mixed carbonate.

Higher molecular weight carbonates and those which contain other functional groups can be prepared by transesterification. This method involves reacting one equivalent of a low molecular weight carbonate, such as dimethyl carbonate, with greater than two equivalents of the appropriate alcohol in benzene, or toluene, and pyridine, or other base. The carbonate can be isolated by fractional distillation.

Generally, the composition of the invention is comprised of a hydrocarbon fuel and a sufficient amount of at least one carbonate to reduce the particulate emissions from the combustion of the fuel. The carbonate additive is usually present from about 0.1 to about 49.9 weight percent, preferably from about 0.1 to about 20 weight percent, and more preferably from about 0.1 to about 10 weight percent based upon the total weight of fuel and carbonate. Typically, the carbonate, which is normally present as a liquid, is admixed by dissolution into the hydrocarbon fuel.

As stated above, hydrocarbon fuels useful for the practice of the present invention include liquid fuels heavier than gasoline, such as residual fuels, kerosene, jet fuels, heating oils, diesel fuels, light gas oil, and heavy gas oil, light cycle gas oils, heavy cycle gas oils, and vacuum gas oils. It should be noted that any liquid hydrocarbon fuel heavier than those in the gasoline boiling range in which the carbonate additive can be admixed to prepare a composition in accordance with the present invention is suitable for the purposes of the present invention. Preferably, the hydrocarbon fuel is a petroleum middle distillate fuel or residual fuel, and more preferably, diesel fuels or other middle distillates.

In addition the additives of this invention can be used to reduce particulate emissions from combustion of certain fuels not derived from petroleum, such as fuels derived from vegetable oils, or of liquid hydrocarbon fuels which contain alcohols. In hydrocarbon fuels containing alcohol, carbonate additives usually exhibit the additional advantage of acting as cosolvents, allowing for miscibility of more alcohol in the hydrocarbon-carbonate mixture than if the carbonate were not present.

The most preferred distillate hydrocarbon stocks useful for preparing the fuel oil compositions of this invention are generally classified as petroleum middle distillates boiling in the range of 350° F. to 700° F. and have cloud points usually from about −78° F. to about 45° F. The hydrocarbon stock can comprise straight run, or cracked gas oil, or a blend in any proportion of straight run and thermally and/or catalytically cracked distillates, etc. The most common petroleum middle distillate fuels are kerosene, diesel fuels, aviation fuels, and some heating oils. Residual fuels, which are also a preferred hydrocarbon fuel, include non-distillate heating oils, such as Grades No. 5 and 6 fuel oils.

A typical heating oil specification calls for a 10 percent ASTM D-86 distillation point no higher than about 420° F., a 50 percent point no higher than about 520° F. and a 90 percent point of at least 540° F., and no higher than about 640° F. to 650° F., although some specifications set the 90 percent point as high as 675° F. A typical specification for a diesel fuel includes a minimum flash point of 100° F., a boiling point range of from about 300° F. to about 700° F., and maximum 90 percent distillation point (ASTM D-86) of 640° F., i.e., 90 percent by volume boils below 640° F. (See ASTM Designation 975.)

The hydrocarbon fuel composition of the present invention may also comprise any of the known conventional additives, such as cetane improvers, dyes, oxidation inhibitors, etc.

The invention further provides a concentrate for use in the liquid fuels disclosed hereinabove comprising: (a) usually from about 0.1 to 99.9 weight percent, of the hereinabove described carbonate additives and (b) the balance of a solvent for the carbonate that is miscible and/or capable of dissolving in the fuel.

Non-limiting examples of suitable solvents are hydrocarbon fuels heavier than gasoline, such as kerosene, diesel fuel, and the like, and hydrocarbon solvents such as hexane and heptane, ether solvents, and mixtures of hydrocarbon solvents, or other organic solvents. Preferably, however, the concentrate is either an undiluted carbonate additive or a solution comprising (a) between about 10 and 50 weight percent of the hereinabove described carbonate additives and (b) a mixture in any proportions of hydrocarbon solvents selected from the group consisting of hexane, heptane, ether solvents, kerosene and diesel fuels.

The following Examples serve to further illustrate and instruct one skilled in the art in the best mode of practicing this invention and are not intended to be construed as limiting the invention thereto.

EXAMPLES 1 THROUGH 14

The following examples demonstrate the reduction of particulate emissions from the combustion of a gaseous hydrocarbon fuel, propane, containing dimethyl carbonate. The procedure for measuring particulate emissions involves combusting the propane in a laminar diffusion flame which is generated and stabilized using a 1.9 centimeter (cm) diameter capillary burner. The burner consists of three concentrically positioned stainless steel tubes which have respective inner diameters of 0.4 cm, 1.1 cm and 1.8 cm. Positioned within and between these tubes are stainless steel hypodermic tubes (0.84 millimeters (mm)). Propane, the desired amount of dimethyl carbonate, and nitrogen are provided through the central tube with oxygen and nitrogen provided through the middle tube. Through the outer concentric tube, a shroud of nitrogen is provided to shield the flame from atmospheric oxygen. The oxygen, nitrogen, and propane are metered into the tubes of the burner through calibrated glass rotometers. The total flow rates of oxygen and nitrogen for all of the examples are 0.96 and 2.35 liters per minute (1 min), respectively. Particulate emission rates are measured as a function of the propane flow rate as listed below in Table 1 for each example. The dimethyl carbonate is added through a 90° "pneumatic" nebulizer and monitored with a motorized syringe pump. The burner is enclosed in a circular cross-sectional quartz chimney (7 cm inner diameter by 45 cm long) which is fitted with a filter holder for collecting particulate emissions. Test durations were 5 minutes for each example shown in Table 1. The concentration of the carbonate in mole percent of dimethyl carbonate based on the total amount of dimethyl carbonate and propane for each example are listed below in Table 1. Fuel was also run using no additive to provide a comparison with the present invention.

While the following examples demonstrate the invention using propane as the hydrocarbon fuel, they also illustrate that under combustion conditions which result in formation of particulates from hydrocarbon fuels, such as middle distillates, the amount of particulates can be reduced by adding carbonates, especially carbonates free of metals and aromatics, to the fuel before combustion. Therefore, the invention is advantageously employed with fuels exhibiting relatively high particulate emissions, such as middle distillate fuels. Thus, while the invention finds use in reducing particulate emissions from the combustion of any hydrocarbon fuel, it is particularly preferable when the fuel is a middle distillate fuel (i.e. diesel fuel).

The particulate emission rates are measured by drawing the exhaust out of the chimney through a fluorocarbon-coated glass fiber filter using a rotary vane vacuum pump. The weight of particulate matter collected on the filter is determined by weighing the filter before and after the test and subtracting the former from the latter.

The results of the particulate emissions measurement for each example are listed in Table 1.

TABLE 1

| Example No. | Propane Flow Rate (Liters/Minute) | Mole Percent Dimethyl Carbonate | Mean Particulate Emission Rate (Milligrams/minute) | No. of Runs | Particulate Reduction (percent) |
|---|---|---|---|---|---|
| 1 | 0.19 | 0 | 7.94 | 2 | 0 |
| 2 | 0.19 | 7.6 | 7.77 | 2 | 2.1 |
| 3 | 0.20 | 0 | 9.96 | 22 | 0 |
| 4 | 0.20 | 7.2 | 9.76 | 4 | 2.0 |
| 5 | 0.22 | 0 | 11.05 | 3 | 0 |
| 6 | 0.22 | 6.6 | 10.93 | 3 | 1.1 |
| 7 | 0.23 | 0 | 11.73 | 24 | 0 |
| 8 | 0.23 | 6.3 | 10.89 | 12 | 7.1 |
| 9 | 0.24 | 0 | 11.13 | 3 | 0 |
| 10 | 0.24 | 6.1 | 11.02 | 3 | 1.0 |
| 11 | 0.25 | 0 | 11.18 | 26 | 0 |
| 12 | 0.25 | 5.9 | 10.45 | 12 | 6.4 |
| 13 | 0.26 | 0 | 10.37 | 3 | 0 |
| 14 | 0.26 | 5.6 | 10.28 | 5 | 0.9 |

As seen above in Table 1, the carbonate additive does effect a reduction in particulate emissions over those runs without any additive.

EXAMPLE 15

Tests to determine emissions of particulates from diesel engines were conducted on a chassis dynamometer using a heavy-duty diesel test vehicle connected to a Constant Volume Sampling (CVS) emissions test system.

The heavy-duty test vehicle was a 1982 International Harvester (IH) Cargostar 1850B equipped with an IH DTI466 direct-injection diesel engine. Chassis dynamometer loading was adjusted to simulate a vehicle loaded with 26,000 pounds gross combined weight (GCW), with measured and calculated load data being taken from Society of Automotive Engineers (SAE) paper No. 840349 entitled "Dynamometer Simulation of Truck and Bus Road Horsepower for Transient Emissions Evaluations."

The experimental technique for collecting and measuring particulate emissions is an adaptation of the Enviromental Protection Agency (EPA) Federal Test Procedure (FTP) for light-duty diesel vehicles described in Federal Register (40 CFR, Part 86). A 1200 cubic feet per minute (cfm) exhaust splitter was used to channel one-half of the exhaust from the test engine into a 600 cfm Beckman CVS emissions test system where it was diluted with air in accordance with the EPA test procedure. Particulate emissions were collected on fluorocarbon-coated glass fiber filters, which were weighed to determine by difference the mass of particulate emissions collected during the test run.

The distance the vehicle travelled was recorded by a resettable counter receiving input from an optical encoder driven by the chassis dynamometer rolls. Results of the particulate emissions tests were calculated on a grams per mile basis.

During testing, a series of runs with fuel containing additive was bracketed between two series of runs using a base fuel containing no additive. Each series of runs contained in sequence hot-start, steady-state and transient tests. During the steady state segment of the series, triplicate steady state runs lasting 10 minutes each were conducted at each of five engine speeds: 55, 40, 30 and 20 miles per hour, and idle. In addition, three modified Highway Fuel Economy Tests (HFET) were run for each series.

A single lot of commercially available No. 2 diesel fuel was used as the base fuel for all tests with 5.3 weight percent of dimethyl carbonate added during the additive tests.

Results of the diesel particulate emissions tests are summarized in Table 2. In runs containing the carbonate additive, the mean particulate emissions are reduced as much as 29 percent compared to emissions from runs containing no additive under all test conditions except idle. Variability in the particulate emissions obtained at idle is so large that comparisons between the base fuel runs and additive runs are probably not valid.

TABLE 2

Reduction in Particulate Exhaust Emissions from a Heavy-Duty Diesel Engine Truck

| Steady-State Speed (mph) Test | Mean Particulate Emissions with No. 2 Diesel Base Fuel (grams/mile) | Mean Particulate Emissions with 5.3 Weight Percent Dimethyl Carbonate Added to No. 2 Diesel Base Fuel (grams/mile) | Particulate Reduction in Percent |
|---|---|---|---|
| 55 | 0.683 | 0.525 | 23 |
| 40 | 0.674 | 0.616 | 9 |

TABLE 2-continued

Reduction in Particulate Exhaust Emissions from a Heavy-Duty Diesel Engine Truck

| Steady-State Speed (mph) Test | Mean Particulate Emissions with No. 2 Diesel Base Fuel (grams/mile) | Mean Particulate Emissions with 5.3 Weight Percent Dimethyl Carbonate Added to No. 2 Diesel Base Fuel (grams/mile) | Particulate Reduction in Percent |
|---|---|---|---|
| 30 | 0.654 | 0.464 | 29 |
| 20 | 0.902 | 0.776 | 14 |
| Idle a | 0.840 | 0.880 | −5 |
| HFET b | 0.671 | 0.520 | 23 |

a Idle emissions are per ten-minute test.
b The FTP Highway Fuel Economy Test modified to meet the slower accelerations and decelerations of a heavy-duty vehicle.

Obviously, many modifications and variations of the invention, as hereinbefore set forth, may be made without departing from the spirit and scope thereof. For example, although the invention is directed to reduction of particulate emissions from liquid hydrocarbon fuels heavier than gasoline, it can be seen that the invention can also be advantageously employed with gaseous hydrocarbon fuels such as methane, ethane, propane, acetylene, or natural gas. Also, although reference has been made to petroleum middle distillates as a preferred fuel, the invention may also be used with success with other middle distillates, such as diesel fuels, aviation fuels, etc., derived from shale, coal or tar sands. Accordingly, it is intended in the invention to enhance these and all such alternatives, modifications, and variations as fall within the spirit and scope of the appended claims.

What is claimed is:

1. A composition comprising:

a particulate reducing amount of an additive comprising two carbonates of the formula:

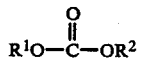

wherein $R^l$ and $R^2$ in the first carbonate and $R^1$ in the second carbonate are monovalent, non-aromatic organic radicals containing between about 1 and 10 carbon atoms and $R^2$ in the second carbonate is a carbalkoxy radical and a liquid hydrocarbon fuel heavier than gasoline.

2. The composition of claim 1 wherein the carbonate additive is from about 0.1 to about 49.9 weight percent of the total weight of the composition.

3. The composition of claim 1 wherein the total mount of carbonate additive is from about 0.to about 20 weight percent of the total weight of the composition.

4. The composition of claim 3 wherein $R^l$ and $R^2$ in the first carbonate and $R^l$ in the second carbonate are the same or different monovalent radicals selected from the group consisting of monovalent alkyl, alkoxyalkyl, carbalkoxyalkyl and carbalkoxy radicals having from 1 to about 10 carbon atoms and $R^2$ in the second carbonate is a carbalkoxy radical comprising from 2 to about 10 carbon atoms.

5. The composition of claim 4 wherein the hydrocarbon fuel is selected from the group consisting of kerosene, jet fuel, heating oil, diesel fuel, light gas oil, heavy gas oil, light cycle gas oil, heavy cycle gas oil, and vacuum gas oil.

6. The composition of claim 4 wherein the hydrocarbon fuel is selected from the group consisting of diesel fuel and heating oil.

7. The composition of claim 4 wherein the hydrocarbon fuel is diesel fuel.

8. The composition of claim 3 wherein $R^1$ and $R^2$ in the first carbonate and $R^1$ in the second carbonate are monovalent radicals selected from the group consisting of monovalvent alkyl and carbalkoxy radicals having between 1 and 7 carbon atoms and $R^2$ in the second carbonate is a carbalkoxy radical comprising from about 2 to about 7 carbon atoms.

9. The composition of claim 8 wherein the hydrocarbon fuel is selected from the group consisting of petroleum middle distillate fuel and residual fuel.

10. The composition of claim 1 wherein the total amount of carbonate additive is from about 0.1 to about 10 weight percent of the total weight of the composition.

11. The composition of claim 10 wherein $R^1$ and $R^2$ in the first carbonate and $R^1$ in the second carbonate are the same or different, substituted or unsubstituted, monovalent alkyl, cycloalkyl, alkenyl, alkynyl, hydroxyalkyl, alkoxyalkyl, nitroalkyl, acyloxyalkyl, carbalkoxyalkyl, carbalkoxy and 1,3 -dioxolane-2-one-4-ylalkyl radicals comprising from 1 to about 10 carbon atoms and $R^2$ in the second carbonate is a carbalkoxy radical comprising from 2 to about 10 carbon atoms.

12. The composition of claim 10 wherein $R^1$ and $R^2$ in the first carbonate and $R^1$ in the second carbonate are the same or different monovalent radicals selected from the group consisting of monovalent alkyl, alkoxyalkyl, carbalkoxyalkyl and carbalkoxy radicals comprising from 1 to about 7 carbon atoms and $R^2$ in the second carbonate is a carbalkoxy radical comprising from 2 to about 7 carbon atoms.

13. A composition comprising:

a middle distillate hydrocarbon fuel; and from about 0.1 to about 49.9 weight percent of a metals-free and non-aromatic carbonate additive based upon the weight of the hydrocarbon fuel and the carbonate additive, said additive containing at least two carbonates of the formula:

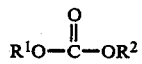

wherein $R^1$ and $R^2$ in the first carbonate and $R^1$ in the second carbonate are monovalvent non-aromatic organic radicals having between 1 and 10 carbon atoms and $R^2$ in the second carbonate is a carbalkoxy radical having between 2 and 10 carbon atoms, the composition having the property of releasing fewer organic particulates upon combustion than would the fuel without the additive.

14. The composition of claim 13 wherein $R^1$ and $R^2$ in the first carbonate and $R^1$ in the second carbonate are the same or different monovalent aliphatic or alicyclic radicals comprising from 1 to about 10 carbon atoms.

15. The composition of claim 13 wherein $R^1$ and $R^2$ in the first carbonate and $R^1$ in the second carbonate are the same or different monovalent aliphatic or alicyclic radicals comprising from 1 to about 7 carbon atoms.

16. The composition of claim 15 wherein the total amount of carbonate additive is form about 0.1 to about 5 weight percent of the total weight of the hydrocarbon fuel and the carbonate additive.

17. The composition of claim 13 wherein $R^1$ and $R^2$ in the first carbonate and $R^1$ in the second carbonate are the same or different monovalent alkyl radical comprising from 1 to about 10 carbon atoms.

18. The composition of claim 17 wherein the amount of carbonate additive is from about 0.1 to about 5 weight percent of the total weight of the hydrocarbon fuel and the carbonate additive.

19. The composition of claim 17, 16, or 18 wherein the middle distillate fuel is a diesel fuel.

20. A method of reducing the particulate emissions from combustion of liquid hydrocarbon fuels heavier than gasoline comprising combusting a mixture containing the hydrocarbon fuel and a particulate reducing amount of a combination of at least two carbonates of the formula:

$$R^1O-\overset{\overset{\displaystyle O}{\|}}{C}-OR^2$$

wherein $R^1$ and $R^2$ in the first carbonate and $R^1$ in the second carbonate are monovalent non-aromatic organic radicals having between about 1 and 10 carbon atoms, and $R^2$ in the second carbonate is a carbalkoxy radical having between 1 and 10 carbon atoms.

21. The method of claim 20 wherein the carbonate additive is from about 0.1 to about 49.9 weight percent of the total weight of the hydrocarbon fuel and the carbonate additive.

22. The method of claim 21 wherein the carbonate additive is admixed with the hydrocarbon fuel in an amount of from about 0.1 to about 5 weight percent of the total weight of the hydrocarbon fuel and the carbonate and wherein $R^1$ and $R^2$ in the first carbonate and $R^1$ in the second carbonate are the same or different monovalent aliphatic or alicyclic radicals comprising from 1 to about 10 carbon atoms.

23. The method of claim 22 wherein the hydrocarbon fuel is diesel fuel.

24. The method of claim 23 wherein the hydrocarbon fuel is combusted in a diesel engine.

25. The method of claim 20 wherein the total amount of carbonate additive is admixed with the hydrocarbon fuel in an amount from about 0.1 to about 10 weight percent of the total weight of hydrocarbon fuel and carbonate additive.

26. The method of claim 20 wherein the total amount of carbonate additive is admixed with the hydrocarbon fuel in an amount of from about 0.1 to about 5 weight percent of the total weight of hydrocarbon fuel and carbonate additive.

27. The method of claim 26 wherein $R^1$ and $R^2$ in the first carbonate and $R^1$ in the second carbonate are the same or different monovalent aliphatic or alicyclic radicals comprising from 1 to about 10 carbon atoms.

28. The method of claim 26 where the first carbonate is dimethyl carbonate and the second carbonate is dimethyl dicarbonate.

29. A composition comprising:

(1) a particulate reducing amount of a metals-free, non-aromatic particulate suppression additive consisting essentially of at least two carbonates, one of said carbonates being a carbalkoxy-containing carbonate, and (2) a liquid hydrocarbon fuel which, if combusted without said additive, would release a substantial proportion of particulates.

30. A composition as defined in claim 29 wherein said additive consists essentially of at least one carbonate compound containing at least 3 carbon atoms.

31. A concentrate comprising:

(a) a carbonate additive comprising at least two carbonates, one of said carbonates being a carbalkoxy-containing carbonate in a concentration of between about 0.1 and 99.9 weight percent of the concentrate; and (b) a solvent for the carbonate, the solvent being miscible in liquid hydrocarbon fuels heavier than gasoline.

32. The concentrate of claim 31 wherein the concentration of the carbonate is between about 10 and 50 weight percent of the concentrate.

33. The concentrate of claim 32 wherein the carbonate is metals-free and non-aromatic.

34. The concentrate of claim 31 wherein the carbonate is metals-free and non-aromatic.

* * * * *

UNITED STATES PATENT AND TRADEMARK OFFICE

CERTIFICATE OF CORRECTION

PATENT NO. : 4,891,049

DATED : Jan. 2, 1990

INVENTOR(S) : Diane M. Dillon and Ross Y. Iwamoto

It is certified that error appears in the above-identified patent and that said Letters Patent is hereby corrected as shown below:

On the title page:

In the Cited References, add -- 3,817,720 6/1974 Moy et al. .... 44/56 --.

Claim 3, Column 7, line 54, delete "mount" and insert therefor -- amount -- and delete "0." and insert therefor -- 0.1 --.

Claim 16, Column 8, line 66, delete "form" and insert therefor -- from --.

Signed and Sealed this

Thirteenth Day of August, 1991

*Attest:*

HARRY F. MANBECK, JR.

*Attesting Officer*

*Commissioner of Patents and Trademarks*